United States Patent [19]

Zoleski et al.

[11] 4,386,001

[45] May 31, 1983

[54] MARINE CRANKCASE LUBRICANT

[75] Inventors: Benjamin H. Zoleski, Beacon; Rodney L. Sung; William P. Cullen, both of Fishkill, all of N.Y.

[73] Assignee: Texaco Inc., White Plains, N.Y.

[21] Appl. No.: 315,571

[22] Filed: Oct. 27, 1981

[51] Int. Cl.[3] ..... C10M 1/48

[52] U.S. Cl. ..... 252/32.7 E; 252/46.7; 252/51.5 A; 252/51.5 R; 252/49.7; 252/42.7

[58] Field of Search ..... 252/32.7 E, 46.7, 51.5 A, 252/51.5 R, 49.7, 42.7

[56] References Cited

U.S. PATENT DOCUMENTS

| | | | |
|---|---|---|---|
| 4,049,564 | 9/1977 | Ryer et al. | 252/51.5 A |
| 4,153,566 | 8/1979 | Ryer et al. | 252/51.5 A |
| 4,253,978 | 3/1981 | Gemmell, Jr. | 252/51.5 A |
| 4,266,944 | 5/1981 | Sung | 44/63 |

*Primary Examiner*—Jacqueline V. Howard

[57] ABSTRACT

A crankcase lubricating oil composition for slow speed marine diesel engines characterized by having a Total Base Number from about 3 to 10 containing a mineral lubricating oil, an overbased calcium alkylphenolate, a zinc dihydrocarbyl dithiophosphate, an ethoxylated alkylphenol, and a friction reducing amount of at least one acyl glycine oxazoline derivative.

7 Claims, No Drawings

MARINE CRANKCASE LUBRICANT

BACKGROUND OF THE INVENTION

1. Field of the Invention

This invention is concerned with a novel crankcase lubricating composition having reduced friction properties in large slow speed marine diesel engines.

One significant development in the shipping field is the trend away from steam turbine propulsion units in favor of large marine diesel engines which are more fuel efficient with respect to petroleum fuels.

The largest marine diesel engines used for ship propulsion are classified as slow speed marine diesel engines. These engines are unique both in their size and in their method of operation. The engines themselves are massive, the larger units approaching 2000 tons in weight and upwards of 100 feet long and 45 feet in height. Their output can reach 50,000 brake horsepower with engine revolutions ranging from about 100 to 125 revolutions per minute.

The slow speed marine diesel engines are unique in their design. Most notably, the crankcase of the large slow speed single acting 2-stroke crosshead type of engine is completely separate from the combustion zone of the engine, i.e. there is no direct communication between the combustion zone and the crankcase zone of this engine. This has led to the use of two different lubrication systems to lubricate a slow speed marine diesel engine. The cylinders in the combustion zone are lubricated with a highly basic 50 to 100 TBN lubricant which functions to counteract the high acidity generated by the use of a high sulfur residual fuel.

The problems encountered in the crankcase of a slow speed marine diesel engine relate to engine wear, lubricant oxidation problems and water separation characteristics which are essential in a shipboard environment. The essential requirements for a crankcase lubricant for this engine include an anti-wear additive, an oxidation-corrosion inhibitor and a demulsifying agent to maintain the operability and effectiveness of the lubricant.

The fuel consumption rate of a marine diesel engine of 30,000 horsepower ranges upwards of 1200 gallons of fuel per hour. In view of the current need to reduce overall oil consumption, intensive efforts are being made to discover lubricating oil compositions which can materially reduce the friction losses which take place within the engine itself. Reductions in engine friction losses translate directly into significant fuel savings.

Numerous means have been employed to reduce the friction in internal combustion engines. These range from the use of lower viscosity lubricating oils or mixtures of mineral and synthetic lubricating oils as well as to the incorporation of friction-reducing additives such as graphite, molybdenum compounds and other chemical additives. There are limits to the extent to which the viscosity of a lubricating oil can be reduced for the purpose of reducing friction. Generally, a lubricating oil having too light a viscosity will fail to prevent metal-to-metal contact during high load operating conditions with the result that unacceptable wear will occur in the engine. With respect to chemical anti-friction additives, significant research efforts are ongoing to find effective and economic anti-friction additives which exhibit stability over an extended service life and under a wide range of operating conditions.

2. Description of Prior Disclosures

Coassigned U.S. Pat. No. 4,266,944 issued May 12, 1981 to R. L. Sung describes and claims the instant acyl glycine oxazolines and their use as detergents in gasoline. Heretofore, experience has shown that ineffective gasoline detergents may be effective in oils and vice versa so that the performance of these compounds in oils was totally unexpected.

U.S. Pat. No. 3,116,252 issued Dec. 31, 1963 to H. S. Beretvas describes a rust inhibiting composition for lubricants consisting of a mixture of an acyl sarcosine, a 1,2-disubstituted imidazoline and an alkylene oxide rosin amine reaction product.

The disclosures of the U.S. patents noted above are incorporated herein by reference.

As will be seen hereinafter, neither of these disclose in any manner applicants' invention.

A copending application, Ser. No. 315,570, filed on Oct. 27, 1981, discloses a cylinder lubricating oil composition.

A copending application, Ser. No. 315,825, filed on Oct. 27, 1981, discloses a lubricant for use in medium and high speed marine diesel engine crankcases.

SUMMARY OF THE INVENTION

The crankcase oil composition of this invention comprises a major amount of a lubricating oil, an overbased calcium alkylphenolate in an amount sufficient to impart a Total Base Number ranging from about 3 to 10 to the lubricating oil composition, a zinc dihydrocarbyl dithiophosphate, an ethoxylated alkylphenol, and a minor friction reducing amount of at least one acyl glycine oxazoline derivative represented by the formula:

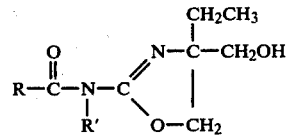

where R is lauryl, $C_{11}H_{23}$, oleyl or stearyl; and R′ is hydrogen or lower alkyl. Preferably R and R′ taken together contain from 13 to 21 carbon atoms.

Preferably, both the R and R′ radicals are straight chain, however they also can be branched and may be substituted with one or more non-interfering substituents such as cyano, trifluoromethyl, nitro or alkoxy.

The novel method of the invention involves operating a medium to high speed marine diesel engine by supplying the above-described lubricating oil composition to the crankcase lubrication system of said engine.

SPECIFIC EMBODIMENTS OF THE INVENTION

In a more specific embodiment of the invention, the crankcase lubricating composition of the invention will comprise at least 80 weight percent of a mineral lubricating oil, from about 1 to 5 weight percent of an overbased calcium alkylphenolate or a sulfurized overbased calcium alkylphenolate sufficient to impart a Total Base Number to the lubricating oil composition ranging between about 3 and 8, from about 0.1 to 1 weight percent of a zinc dithiophosphate represented by the formula:

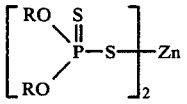

in which R is a hydrocarbyl radical or a hydroxy substituted hydrocarbyl radical having from about 3 to 12 carbon atoms, from about 0.05 to 1 weight percent of an ethoxylated alkylphenol having the formula:

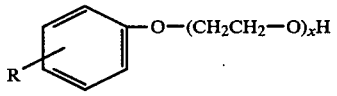

in which R is a hydrocarbyl radical having from about 4 to 16 carbon atoms and x has a value from 1 to 10, and a minor friction modifying amount of the above oxazoline derivative.

The composition can also contain minor amounts of a antifoam agent such as a dialkyl silicone.

In general, the friction reducing compounds of the invention are synthesized as described in U.S. Pat. No. 4,266,944 by reacting a 2-amino-2-(lower) alkyl-1,3-propanediol with an N-acyl sarcosine in an inert solvent, preferably xylene, refluxing the reaction mixture for about 8 hours to remove by azeotroping the xylene and the water of reaction; filtering and stripping the filtrate under vacuum to isolate the product.

The reaction proceeds as follows:

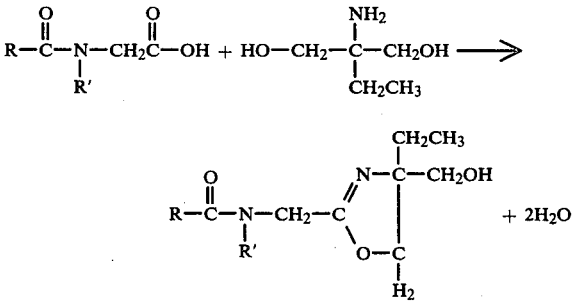

where R and R' are as above.

N-acyl sarcosines suitable as reactants include lauroyl sarcosine, cocoyl sarcosine, oleoyl sarcosine, stearoyl sarcosine and other fatty sarcosines containing from 8 to 22 carbon atoms. The preferred propanediol is 2-amino-2-ethyl-1,3-propanediol.

Preferred friction modifying components for the lubricating oil of the invention are those where R is lauryl or oleyl. These are effective in a range from about 0.1 to 5 weight percent based on the total lubricating oil composition. However, it is preferred to employ from about 0.5 to 2 weight percent of the derivative based on the weight of the lubricating oil with the most preferred concentration ranging from about 0.75 to 1.5 weight percent.

The following examples illustrate the best mode of making and using the friction reducing additive component of the cylinder oil composition of the invention.

EXAMPLE I

Synthesis of Oxazoline of Sarkosyl O

A mixture of 0.7 mole of oleyl sarcosine and 0.7 mole of 2 amino-2-ethyl 1,3 propanediol in 600 parts of xylene was refluxed and water of reaction was azeotroped over. After 8 hours of reflux, the reaction mixture was cooled and filtered, then stripped under vacuum. The residue was analyzed by I. R. and elemental analysis.

EXAMPLE II

A mixture of 0.7 mole of lauroyl sarcosine and 0.7 mole of 2-amino-2-ethyl,1,3 propanediol in 600 ml. of xylene was refluxed and water of reaction was azeotroped over. At the end of 8 hours, the reaction was stripped, filtered, and stripped under vacuum. The residue was analyzed by I. R. and elemental analysis.

EXAMPLE III

A mixture of 0.7 mole of cocoyl sarcosine and 0.7 mole of 2-amino-2-ethyl-1,3-propanediol is reacted as in Example I to give the oxazoline of cocoyl sarcosine.

EXAMPLE IV

A mixture of 0.7 mole of stearyl sarcosine and 0.7 mole of 2-amino-2-ethyl-1,3-propanediol is reacted as in Example I to give the oxazoline of stearyl sarcosine.

The second essential component of the crankcase lubricating oil composition of the invention is an overbased calcium alkylphenolate or phenate or a sulfurized overbased calcium alkylphenolate in a sufficient amount to provide a Total Base Number ranging from 3 to 10 in the finished crankcase lubricating oil composition. Total Base Number (TBN) is a measure of alkalinity determined according to the test procedure outlined in ASTM D-664.

The alkalinity agent comprises at least one overbased calcium alkylphenolate or sulfurized overbased calcium alkylphenolate including the corresponding calcium carbonate overbased calcium alkylphenolate salt. In general, these materials are prepared by reacting a alkylphenol in which the alkyl radical has from 5 to 50 carbon atoms, preferably from 10 to 20 carbon atoms with a basic calcium compound such as calcium oxide, calcium hydroxide, calcium alkoxyalkoxide, or calcium carbonate to effect the formation of the overbased calcium alkylphenolate. If the corresponding sulfurized compound is desired, sulfur is reacted with the calcium alkylphenolate prior to or after it has been converted to its overbased form. Methods for making overbased calcium alkylphenolates are well known and do not constitute a part of this invention. Specific details for preparing overbased calcium alkylphenolates and sulfurized overbased calcium alkylphenolates are disclosed in U.S. Pat. Nos. 3,779,920 and 3,761,414 and the disclosures in these references are incorporated herein by reference.

The prescribed alkylphenolate is employed in the crankcase lubricant of the invention in a concentration sufficient to provide a Total Base Number from about 3 to 8, and preferably from 5 to 6, in the finished lubricating oil composition. In general, this will require from about 1 to 5 weight percent of the alkylphenolate salt on a neat basis.

The essential zinc dithiophosphate component of the lubricating oil is represented by the formula:

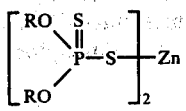

in which R is a hydrocarbyl radical or a hydroxy-substituted hydrocarbyl radical having from 3 to 12 carbon atoms. The preferred zinc dithiophosphates are those in which R represent an alkyl radical having from 4 to 8 carbon atoms. Examples of suitable compounds include zinc isobutyl 2-ethyl-hexyl dithiophosphate, zinc di(2-ethylhexyl)dithiophosphate, zinc isoamyl 2-ethylhexyl dithiophosphate, zinc di(phenoxyethyl)dithiophosphate and zinc di(2,4-diethylphenoxyethyl)dithiophosphate. In general, these compounds are employed in the oil composition in a concentration ranging from about 0.1 to 1.0 weight percent with a preferred concentration ranging from about 0.5 to 1.5 percent. These compounds can be prepared from the reaction of a suitable alcohol or mixture of alcohols with phosphorus pentasulfide. They are illustrated in U.S. Pat. Nos. 2,344,395; 3,293,181 and 3,732,167 which are incorporated herein by reference.

The ethoxylated alkylphenol is an essential demulsification and water separation component for a marine diesel crankcase lubricating oil composition. This component is represented by the formula:

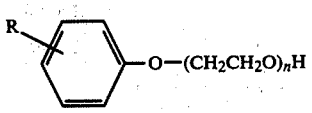

wherein R represents an alkyl radical having from 4 to 20 carbon atoms and n has an average value ranging from about 4 to about 30. A preferred ethoxylated alkylphenol is one in which R is an alkyl radical having from about 8 to 12 carbon atoms and n has a value ranging from 5 to 10. Ethoxylated alkylphenols are disclosed in U.S. Pat. No. 3,548,949 and this disclosure is incorporated herein by reference.

The ethoxylated alkylphenol is employed in the lubricating oil composition of the invention in a concentration ranging from about 0.05 to 1 weight percent. However, it is preferred to employ from about 0.1 to 0.5 weight percent of this additive the most preferred concentration being from about 0.2 to 0.4 weight percent.

The prescribed lubricating oil composition of the invention may contain additional known lubricating oil additives. An oxidation inhibitor which can be beneficially employed is an alkylated diphenylamine represented by the formula:

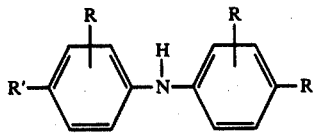

in which R is an alkyl radical having from 1 to 4 carbon atoms and R' is an alkyl radical having from about 4 to 16 carbon atoms. A more preferred compound is one in which R' is a tertiary alkyl hydrocarbon radical having from 6 to 12 carbon atoms. Examples of typical compounds include 2,2'-diethyl, 4,4'-tert. dioctyldiphenylamine, 2,2-diethyl, 4,4-tert. dioctylphenylamine 2,2'-diethyl, 4-tert. octyldiphenylamine, 2,2' dimethyl-4,4'tert. dioctyldiphenylamine, 2,5-diethyl,4,4'-tert.-dihexyldiphenylamine, 2,2,2',2'-tetraethyl, 4,4'-tert. didodecyldiphenylamine and 2,2' dipropyl4,4'-tert. dibutyldiphenylamine. Mixtures of the foregoing compounds can be employed with equal effectiveness. The alkylated diphenylamine is normally employed in an oil composition in a concentration ranging from about 0.1 to 2.5 percent weight percent based on the weight of the lubricating oil composition, with the preferred concentration being from about 0.25 to 1.0 percent.

The hydrocarbon oil which can be employed to prepare the diesel lubricating oil composition of the invention includes naphthenic base, paraffinic base and mixed base mineral oils, lubricating oil derived from coal products and synthetic oils, e.g., alkylene polymers such as polypropylene and polyisobutylene of a molecular weight of between about 250 and 2500. Advantageously, a lubricating base oil having a lubricating oil viscosity SUS at 100° F. of between about 50 and 1500, preferably between 100 and 1200, are normally employed for the lubricant composition. The most preferred lubricating viscosity for a crankcase lubricating oil composition is a viscosity ranging from about 56 to 68 SUS at 210° F. The hydrocarbon oil will generally constitute from about 80 to 90 weight percent of the total lubricating oil composition with the preferred concentration range being from about 82 to about 88 weight percent.

The improvement in fuel economy brought about by the novel crankcase lubricant composition of the invention was demonstrated in the Small Engine Friction Test. The Small Engine Friction Test (SEFT) uses a single cylinder, air-cooled, 6-horsepower engine driven by an electric motor. The engine has a cast-iron block and is fitted with an aluminum piston and chrome-plated rings. The electric motor is cradle-mounted so that the reaction torque can be measured by a strain arm. The engine is housed in a thermally insulated enclosure with an electric heater and is driven at 2000 rpm.

Prior to each test, the engine is flushed three times with 1-quart charges of test oil. During the test run, the engine and oil temperatures are increased continually from ambient until a 280° F. oil temperature is reached. The heat comes from engine friction, air compression work and from the electric heater. The engine and oil temperatures and the engine motoring torque are recorded continually during the test. A SEFT run takes about 4 hours. Each test oil evaluation is preceded by a run on a reference oil for a like period of time. The torque reference level for the engine shifts very slowly with time as a result of engine wear. Therefore, the test oil results were recorded compared to a reference band consisting of data from up to three reference runs made before and three runs made after the test oil evaluation.

The frictional effects of the novel lubricating oil composition of the invention containing the prescribed friction modifier was evaluated in a commercial marine diesel lubricating oil composition. The commercial lubricant or base oil and the modified oil containing the friction modifier of the invention were tested for their friction properties in the Small Engine Friction Test described above.

The following examples illustrate the effectiveness of the additive of the invention in a 6 TBN marine crankcase oil composition.

TABLE I

EXAMPLE V
SMALL ENGINE FRICTION TEST ON
6 TBN MARINE CRANKCASE OIL

| | Marine Crankcase Oil (Base Oil) | Modified Marine Crankcase Oil A |
|---|---|---|
| Composition, Wt. % | | |
| Solvent Neutral Oil - SUS at 100° F. of 230 | 24.02 | 24.02 |
| Solvent Neutral Oil - SUS at 100° F. of 1575 | 71.60 | 70.60 |
| Zinc Dithiophosphate(1) | 0.48 | 0.48 |
| Overbased sulfurized(2) calcium phenate | 3.30 | 3.30 |
| Ethoxylated phenol(3) | 0.30 | 0.30 |
| Alkylated diphenylamine(4) | 0.30 | 0.30 |
| Dimethyl silicone, ppm | 150 | 150 |
| Additive Example I | — | 1.00 |

(1)Zinc salt of mixed ($C_4$–$C_2$) alcohols/$P_2S_5$ product; 11.5% Zn
(2)Overbased sulfurized calcium alkylphenate of 147 TBN (sold under the trademarked name of Oronite 218A)
(3)Nonylphenol ethoxylated with 6 ethylene oxide moieties
(4)Dinonyldiphenylamine antioxidant

EXAMPLE VI

An oil is prepared by adding 0.2 weight percent of the product of Example II to the base oil of Example V.

EXAMPLE VII

A friction modified oil is prepared by adding 0.5 percent of the product of Example III to the base oil of Example V.

EXAMPLE VIII

An oil is prepared by adding 2 weight percent of the product of Example II to the base oil of Example V.

TABLE II

SMALL ENGINE FRICTION TEST

| | Crankcase Oil (Base Oil) | Modified Crankcase Oil (Oil A) |
|---|---|---|
| Engine Motor Torque, Foot Lbs. at 280° F. | 2.84 | 2.65 |
| Frictional Improvement over Base Oil, % | — | 6.7 |

The foregoing examples demonstrate an unexpected effectiveness of acyl glycine oxazolines as friction modifiers for reducing engine motor torque in the prescribed marine crankcase oil composition of the invention to provide attendant fuel economies.

We claim:

1. A crankcase lubricating oil composition having a Total Base Number in the range from about 3 to 10 comprising a major proportion of a mineral lubricating oil containing from about 1 to 5 weight percent of at least one overbased salt selected from the group consisting of calcium alkylphenolate, sulfurized calcium alkylphenolate and mixtures thereof, from about 0.1 to 1 weight percent of a zinc dithiophosphate represented by the formula:

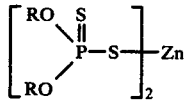

in which R is a hydrocarbyl radical or a hydroxy substituted hydrocarbyl radical having from 3 to 12 carbon atoms, from about 0.5 to 1 weight percent of an ethoxylated alkylphenol represented by the formula:

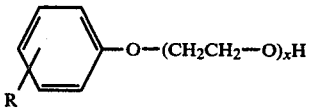

wherein R represents an alkyl radical having from 4 to 20 carbon atoms and x has an average value ranging from about 4 to about 30 and, from about 0.2 to 5 weight percent of at least one acyl glycine oxazoline derivative of the formula:

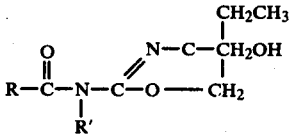

where in R is lauryl, $C_{11}H_{23}$, oleyl or stearyl; R′ is hydrogen or (lower) alkyl.

2. A crankcase lubricating oil composition according to claim 1 containing from about 0.2 to 5 weight percent based on said lubricating oil composition of said derivative.

3. A crankcase lubricating oil composition according to claim 1 in which the concentration of said derivative ranges from about 0.75 to 1.5 weight percent.

4. The composition of claim 1 wherein said derivative is the oxazoline of oleyl sarcosine.

5. The composition of claim 1 wherein said derivative is the oxazoline of lauroyl sarcosine.

6. The composition of claim 1 wherein said derivative is the oxazoline of cocoyl sarcosine.

7. The composition of claim 1 wherein said derivative is the oxazoline of stearoyl sarcosine.

* * * * *